United States Patent [19]

Vollmer et al.

[11] Patent Number: 5,027,530

[45] Date of Patent: Jul. 2, 1991

[54] DRYING APPARATUS

[76] Inventors: Frederick E. Vollmer, 4501 Grey Dawn, Arlington, Tex. 76017; James L. Taylor, 208 Hibiscus, Arlington, Tex. 76018

[21] Appl. No.: 578,256

[22] Filed: Sep. 6, 1990

[51] Int. Cl.[5] ..... F26B 17/24

[52] U.S. Cl. ..... 34/58; 34/236; 210/781

[58] Field of Search ..... 34/58, 236, 8; 210/368, 210/369, 371, 377, 360.1, 380.1, 380.3, 781, 784

[56] References Cited

U.S. PATENT DOCUMENTS

| | | | |
|---|---|---|---|
| 3,313,034 | 4/1967 | Meyer | 34/58 |
| 4,461,096 | 7/1984 | Suzuki | 34/58 |
| 4,493,156 | 1/1985 | Siegmann | 34/58 |

OTHER PUBLICATIONS

Bock Instruction Manual for Method FP-90, FP-9000 from Bock of Toledo, Ohio.

*Primary Examiner*—Henry A. Bennet
*Assistant Examiner*—Denise L. Gromada
*Attorney, Agent, or Firm*—Richards, Medlock & Andrews

[57] ABSTRACT

An apparatus (30) is disclosed for effective drying of material, such as vegetables, by centrifugal force. The apparatus (30) includes a series of conveyor assemblies (52–58) distributed on a rotating shaft (34). A gear ring (76) can be held stationary while the shaft rotates to move conveyor belts (70) within the apparatus to simultaneously load material to be dried while dried material is removed from the other end of the apparatus. When the conveyor belts are loaded, the shaft and conveyor assemblies can be rotated at a higher rotational velocity to dry the materials for a predetermined period of time.

5 Claims, 4 Drawing Sheets

DRYING APPARATUS

TECHNICAL FIELD

This invention relates to an apparatus for drying material, and is particularly suitable for the drying of vegetables.

BACKGROUND OF THE INVENTION in the processing of produce and vegetables, it is common to dip the vegetables in chilled water at 34° F. with a slight trace of chlorine, usually 60 parts per million, to preserve the vegetables. After the vegetables are dipped, excess moisture must be removed from the vegetables to prevent rot. In the past, this drying operation has been performed in devices of the type manufactured by the Bock Company of Toledo, Ohio and identified as centrifuges.

A typical centrifuge of the type used to dry vegetables includes an open topped tub with holes in the side and bottom, much like the tub of a conventional home washing machine, which is filled with the produce to be dried. This tub is inserted through the top of an apparatus which spins the tub around a vertical axis at a high rotational speed, usually 1200 rpm. The centrifugal force exerted on the vegetables at this rotational velocity will cause excess moisture to be flung outward, through the holes in the tub, for removal.

A number of disadvantages exist in the apparatus currently used. The weight of the vegetables to be dried and the tub in which they are placed is commonly over 300 pounds, which requires an overhead crane or similar lifting apparatus to install and remove the drum and vegetables. Further, the area surrounding such machines is almost invariably wet and slippery because of the operation and is an unpleasant and potentially dangerous environment for workers. Also, as the vegetables are stacked within the tub from the vertical axis of rotation to the tub wall, the vegetables near the tub wall tend to be crushed by the centrifugal forces generated, leading to the possibility of damaging the vegetables.

A need exists for a mechanism to more effectively dry vegetables after water chilling. It would also be of significant benefit to be able to control the degree of moisture removal precisely to accommodate the particular vegetable moisture content most suitable for preservation of the particular vegetable being dried. Finally, a machine of such design could have wide applications in drying materials other than vegetables, for example, sewage and sludge, where moisture removal is an essential step in the treatment process.

SUMMARY OF THE INVENTION

In accordance with one aspect of the present invention, an apparatus is provided to dry a material by centrifugal forces. The apparatus includes a frame and a shaft mounted for rotational motion about a first axis on the frame. A conveyor assembly is mounted on the shaft for rotation with the shaft. The convey assembly includes a conveyor extending in a direction parallel the first axis from a first position to a second position. A drive mechanism is provided in the conveyor assembly for moving the conveyor to convey material on a conveyor from the first to the second positions. A drive ring is mounted for rotation about the first axis and is in engagement with the drive mechanism of the conveyor assembly. Rotation of the drive ring with the drum induces no motion of the conveyor. Relative rotation between the drive ring and the drum induces motion of the conveyor to convey the material from the first to the second positions.

In accordance with another aspect of the present invention, a plurality of conveyor assemblies are mounted to the shaft. In accordance with another aspect of the present invention, a drive mechanism is provided to rotate the shaft and conveyor assembly about the first axis at a first rotational velocity to load and unload material from the conveyor and a second rotational velocity to dry the material on the conveyor.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION

Figure 1:
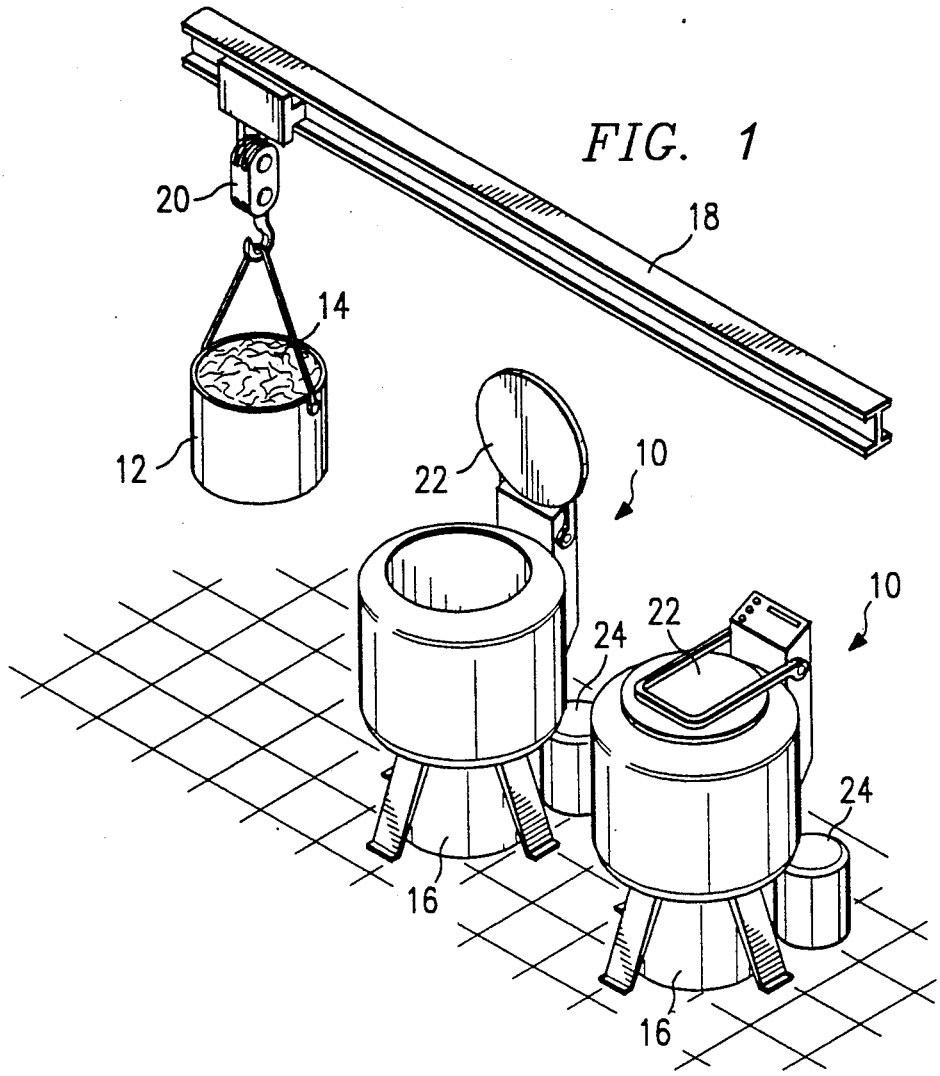
FIG. 1 is a perspective view of the type of apparatus currently used to dry vegetables with centrifugal force.
Figure 5:
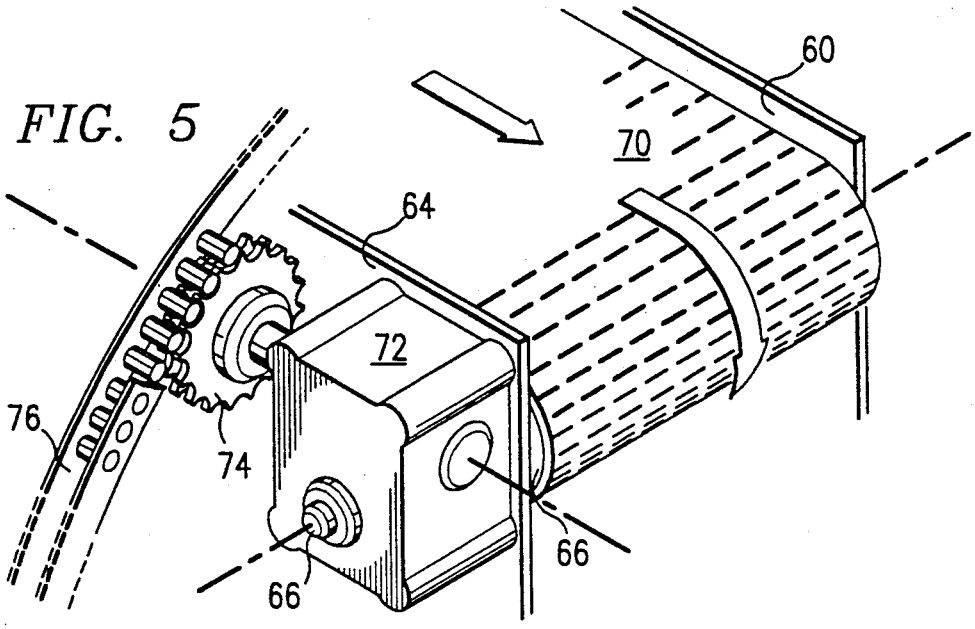
FIG. 5 is a perspective illustrative view of the drive mechanism for a conveyor used in the apparatus.

With reference to FIG. 1, an apparatus !0 is illustrated of the type currently used to dry vegetables, such as lettuce, after water chilling and treating with a small quantity of chlorine. An apparatus of this type is manufactured and sold by Bock of Toledo, Ohio as their model FP series centrifuge. The apparatus 10 has a removable drum 12 with an open top and a series of holes in its sides and bottom. The vegetables 14 to be dried are put in the drum 12 through its open top and conveyed to the spinning mechanism 16. An overhead crane 18 and tackle 20 is usually employed because the weight of the drum 12 with vegetables is typically in excess of 300 pounds. The drum 12 is carefully inserted in the open top of the mechanism 16 to fit over the spinning mechanism. A protective cover 22 is closed down over the opening and an electric motor 24 begins to spin the drum 12 about a vertical axis through a transmission. The drum 12 is rotated at an angular velocity of about 1200 rpm in a typical application, which will be adequate to dry the vegetables 14. The excess water removed from the vegetables passes through the holes in the drum 12 and collects at the bottom of the spinning mechanism 16 for disposal. When the vegetables are dried, the drum is stopped, and removed from the mechanism 16 for further processing of the vegetables. The use of an apparatus 10 is very labor intensive, requiring workers to convey the drums to and from the spinning mechanisms. The area also is constantly wet and slippery, requiring the worker to be extremely careful while performing these operations.

With reference now to FIGS. 2–5, an apparatus 30 is illustrated which forms a first embodiment of the present invention. As will be discussed hereafter, the apparatus 30 has significant advantages over the apparatus 10, including the ability to automate the loading and unloading procedures for the vegetables, reducing the labor required and the exposure of personnel to dangerous operating conditions. Apparatus 30 further has the advantage of providing better control of the amount of moisture removed and is less damaging to the vegetables during the moisture removal process.

Figure 2:
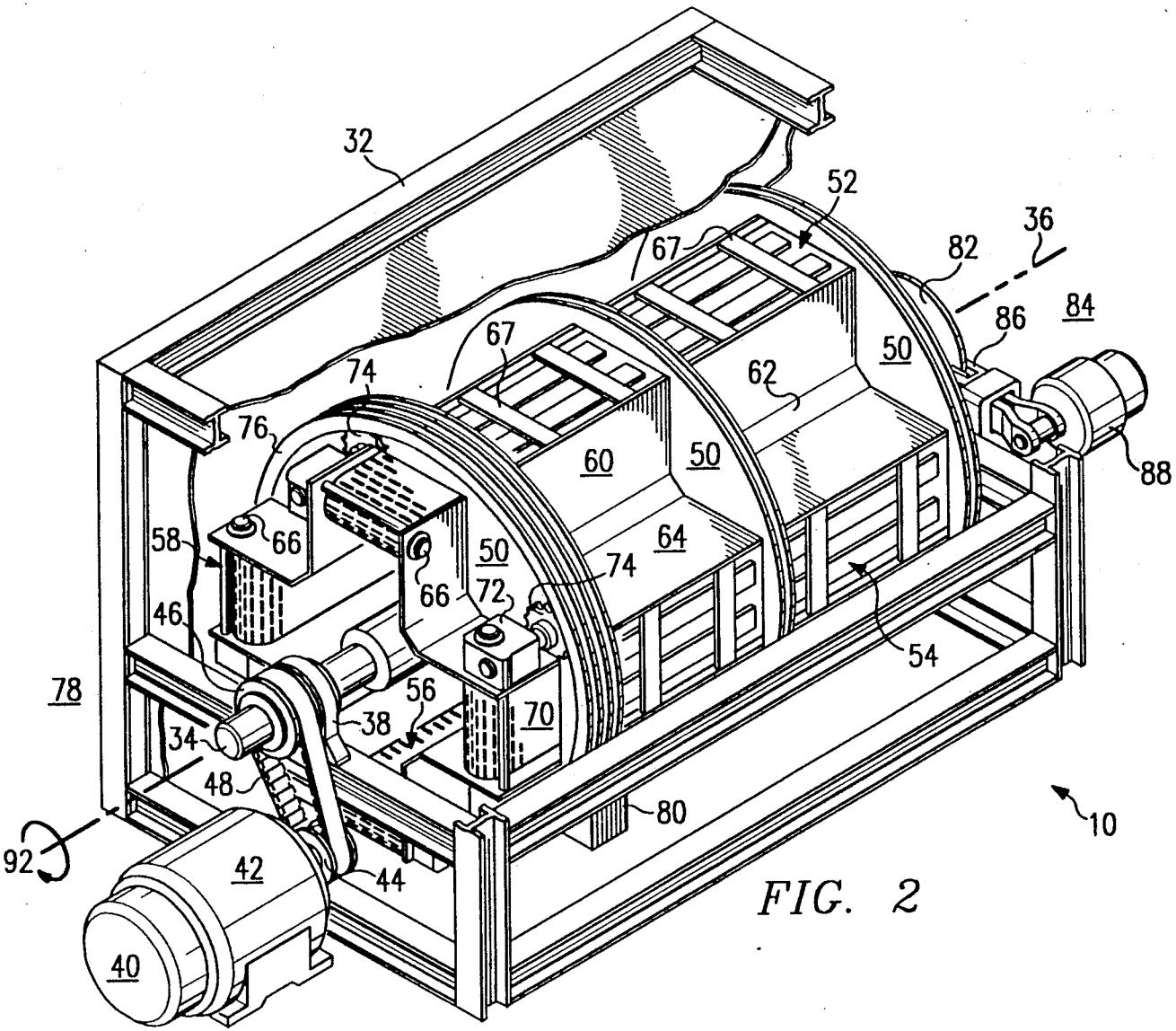
FIG. 2 is a perspective view of an apparatus, in partial cross-section, forming a first embodiment of the present invention.
Figure 3:
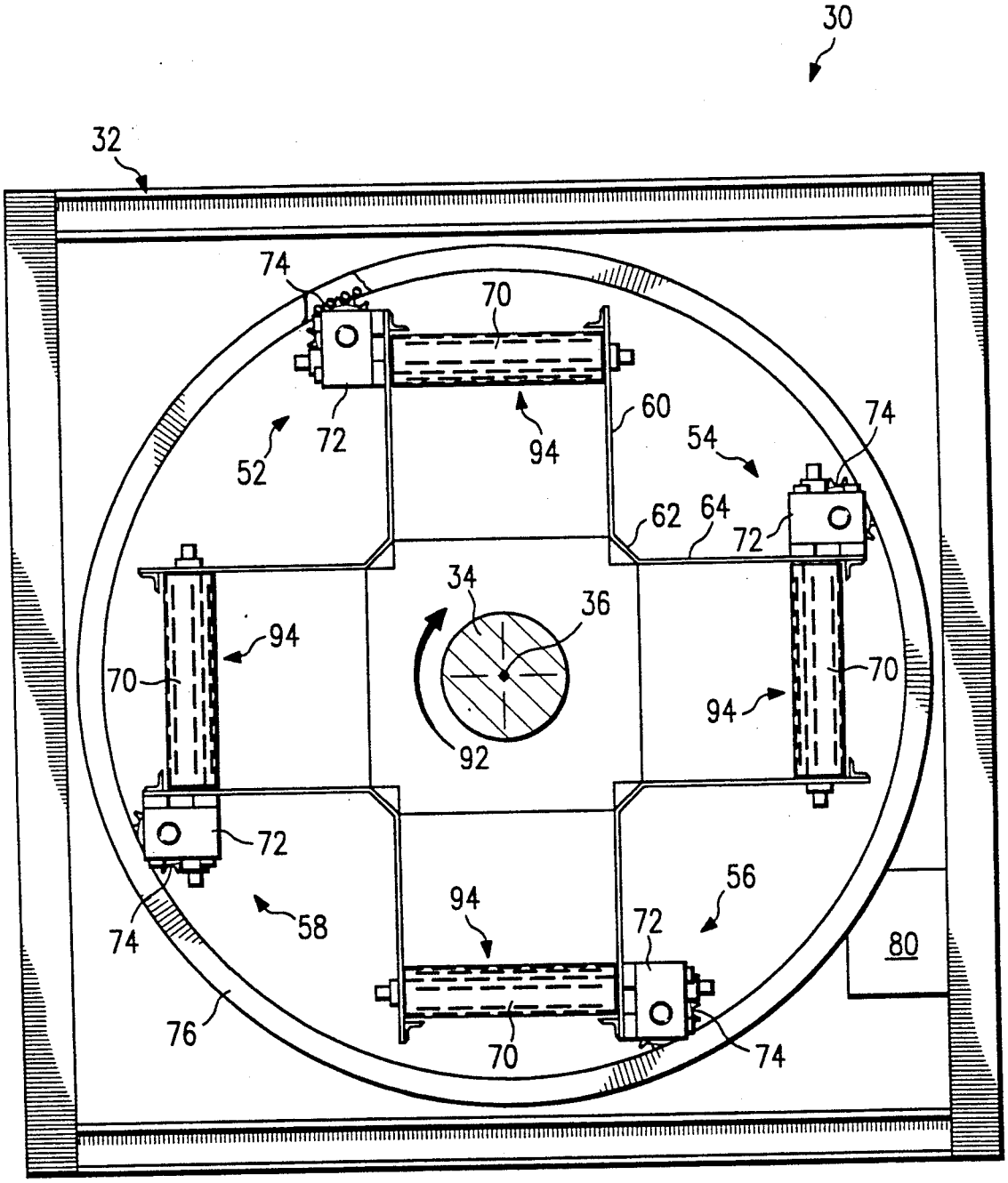
FIG. 3 is an end view of the apparatus of FIG. 2.
Figure 4:
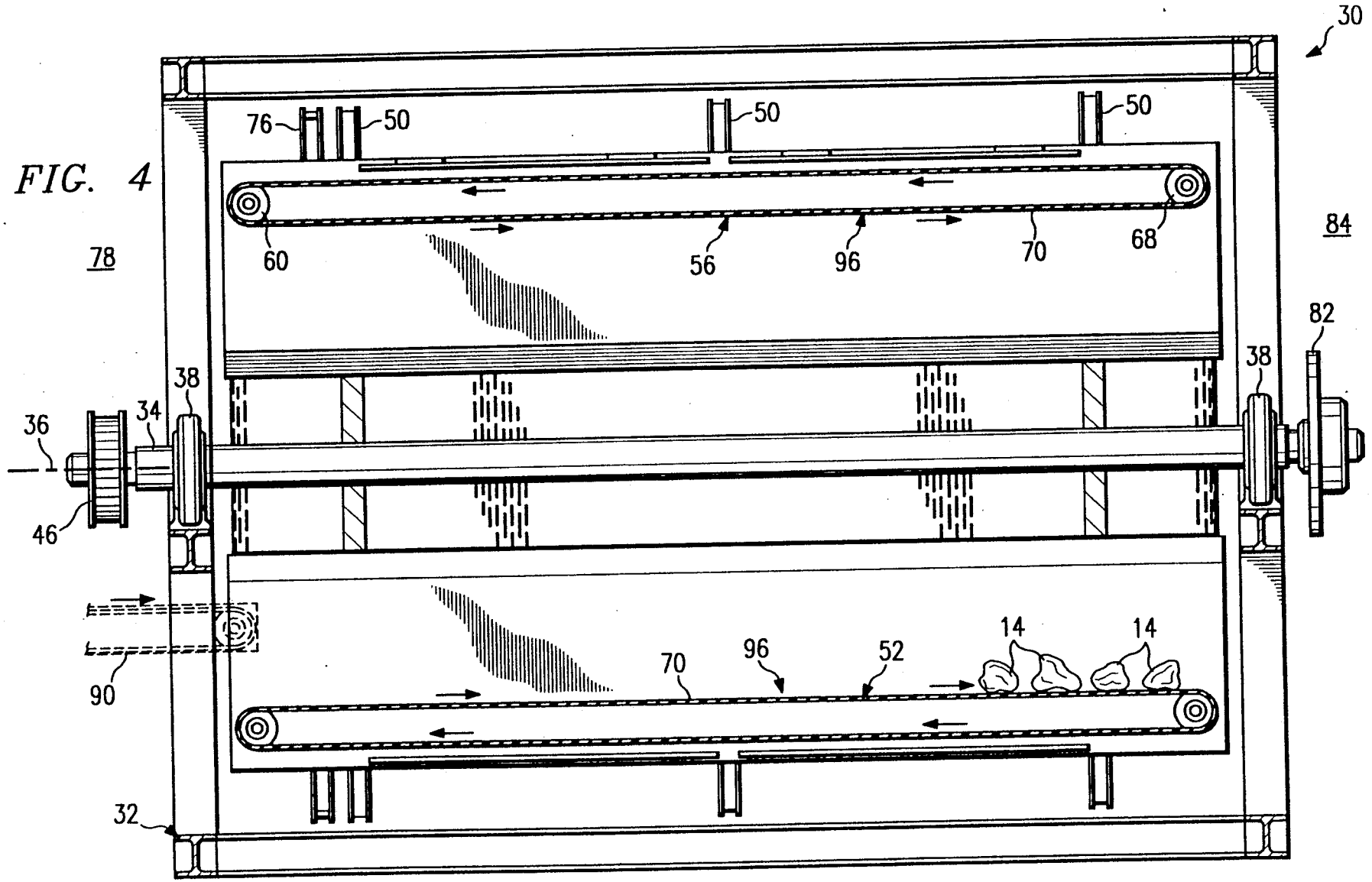
FIG. 4 is a vertical cross-sectional view of the apparatus of FIG. 2.

With reference to FIG. 2, the apparatus 30 includes a stationary frame 32 which supports a shaft 34 for rotation about a first axis 36 through pillow block bearings 38 at either end of the shaft. The axis 36 is horizontal. An electric motor 40 and eddy current drive 42 are mounted to or beside the frame 32 to rotate the shaft 34 through pulley 44 on the drive 42, pulley 46 on the shaft 34 and the interconnecting cogged belt 48.

Along the shaft 34 are secured a series of disks 50. The disks 50 support a series of four conveyor assemblies 52, 54, 56 and 58 for rotation with the shaft 34. As can be seen in FIG. 2, the conveyor assemblies are symmetrically distributed about the shaft at 90° angles relative to the adjacent conveyor assembly.

A series of plates 60, 62 and 64 are mounted to the disks 50 and extend through shaped apertures through the disks. Conveyor rollers 66 and 68 are rotatably mounted between adjacent plates 60 and 64. Ribs 67 also extend between plates 60 and 64 to support the plates and conveyor assembly. An endless conveyor belt 70 extends between each pair of rollers 66 and 68 and is aligned along a direction parallel to the first axis 36. A gear drive unit 72 is mounted on each plate 64 and connected to the roller 66 so that rotation of a gear wheel 74 on each unit 72 will induce a similar rotation of the conveyor roller 66 at whatever gear reduction ratio is provided by the gear drive unit. Rotation of rocker 66 in turn, moves the conveyor belt in a direction parallel the first axis. The teeth of each gear wheel 74 are engaged with the teeth in an annular gear ring 76 which is mounted to the disk 50 adjacent the first end 78 of the apparatus in a manner so that the gear ring 76 can rotate independently of the disks 50 and shaft 34 about the first axis. A mechanism 80 is provided which selectively permits the gear ring 76 to be locked to the adjacent disk 50 for joint rotation at the same angular velocity, or alternatively to the frame 32 with the gear ring 76 stationary while the shaft, disks 50 and conveyor assemblies 50–58 rotate about the first axis relative to the gear ring. It will be understood that if the rotational velocity of the gear ring about axis 36 is different from that of the gear drive units 72, rotation of the gear wheels 74 will ensue and the conveyor belts 70 will move in a direction parallel the first axis. Conversely, if the gear ring 76 is locked to the adjacent disk 50, no rotation of gear wheels 74 will occur and the conveyors will have no movement along a direction parallel the first axis.

A brake disk 82 is mounted on the shaft 34 adjacent the second end of the apparatus. A disk brake caliper 86 is mounted to the frame 32 and operated by a power source, such as air cylinder 88, to exert a braking action on the disk 82 and thus slow the rotation of the shaft 34 and attached structure.

A supply conveyor 90 is positioned adjacent the first end 78 of the apparatus 30. To load material, such as vegetables, into the apparatus 30 for drying, the supply conveyor 90 will convey materials into the apparatus 30 and permit them to drop by gravity onto one of the conveyor belts 70 as the apparatus 30 is rotated in the direction of arrow 92 about the axis 36 at a relatively slow loading angular velocity. This angular velocity is selected so that the centrifugal forces exerted on the materials is at least sufficient to hold the materials on the conveyor belts on which they dropped as they apparatus is rotating. Any materials dropping between the belts as the apparatus rotates will fall on one of the plates 60-64 and will simply slide down on the plates onto a belt. During the loading operation, the mechanism 80 holds the gear ring 76 stationary so that the conveyor belts 70 move, with the inner section 96 of each conveyor belt on which the material is placed moving in the direction from the first end 78 to the second end 84. By carefully timing the operation of supply conveyor 90 and the rotational velocity of apparatus 30, material will be dropped on each conveyor belt just after the conveyor belt has moved sufficiently to move the previously dropped material out of the way to fully load each conveyor with material to be dried.

Once the conveyors are fully loaded with material, the supply conveyor 90 stops and the mechanism 80 locks the gear ring 76 into rotation with the adjacent disk 50 at the same angular velocity. Movement of the conveyor belts is thus halted in the direction parallel the rotational axis.

The motor 40 and eddy current drive 42 are then activated to accelerate the shaft 34 and attached structure to a higher rotational velocity to dry the material on the conveyor belts with centrifugal force. Use of an eddy current drive is preferred as the motor speed can be maintained relatively constant while the drive provides accurate speed control. Preferably, a cylindrical shell 96 is positioned about the shaft 34 and attached structure so that moisture flung out by centrifugal force from the materials will impinge upon the inner surface of the shell and flow by gravity to the bottom of the shell for disposal.

After a predetermined period of time at the chosen angular velocity to complete drying, the motor 40 and drive 42 permit the shaft 34 and attached structure to again slow to the loading rotational velocity, whereupon the mechanism 80 again stops movement of the gear ring 76. The conveyor belts then begin to move to convey the dried material out the second end 84 of the apparatus 40 for placement on another conveyor mechanism (not shown) or otherwise removed for further processing. If another load of material is to be dried subsequently, the supply conveyor 90 and the mechanism for removing the dry material can be coordinated so that the conveyor belt literally will be discharging dried material from end 84 while accepting material to be dried at the other end. Each conveyor belt ideally need only be moved a distance corresponding to the span between the rollers 66 and 68 to simultaneously unload a dried conveyor belt full of material and accept a conveyor belt full of material to be dried.

In accordance with one apparatus constructed in accordance with the teachings of the present invention, the shaft 34 is rotated at an angular velocity of approximately 60 rpm for loading material to be dried and unloading the dried material. The shaft is then accelerated to an angular velocity of 900–1000 rpm for drying. When drying lettuce, it would be expected that 45 seconds of rotation at this higher angular velocity would be sufficient to dry the lettuce. When the apparatus 30 is to be used for drying produce or vegetables, the materials of which the apparatus 30 is constructed should be suitable food grade materials. For example, the majority of parts in the apparatus 30 can be made of stainless steel. The conveyor belts themselves can be made of a suitable plastic such as nylon. A 40 or 50 horsepower motor was used with an eddy current drive manufactured by U.S. Electrical Motors of Milford, Conn.

The apparatus 30 provides an opportunity to automate the drying process not previously possible with the prior dryer designs. The apparatus 30 can be operated by a microprocessor based operating system which causes the apparatus 30 to go through an entire sequence of the drying operation based on the parameters desired for the particular materials being dried. For example, in drying vegetables, lettuce, cucumbers and radishes are each optimally dried by selecting a different duration of spinning at the high angular velocity or even spinning the produce at different angular velocities to accommodate the peculiarities of each vegetable, which is readily possible with such a control system. Further, photoelectric sensors can be mounted on the apparatus 30 to sense when produce is removed from or added to each of the conveyor belts so that the apparatus 30 is not accelerated to the drying angular velocity until each of the conveyors belts is fully loaded, thus increasing the efficiency of the apparatus.

The apparatus 30 is also quite easy to clean. A spray system can be provided through the shaft 34, for example, to rinse, foam and sanitize the entire apparatus as the shaft is rotated. In the unlikely event an emergency stop of the shaft and attached structure is necessary, this brake caliper 86 can be activated by air cylinder 88 to stop the rotation of the shaft virtually instantaneously.

While the discussion of apparatus 30 has been primarily addressed to the drying of vegetables, such as lettuce, it is clear that the apparatus 30 can be utilized to dry virtually any material, specifically including garbage, sewage or sludge where moisture removal is essential to treatment.

Although the present invention has been described with respect to specific preferred embodiments thereof, various changes and modifications can be suggested to one skilled in the art and it is intended that the present invention encompass such changes and modifications as fall within the scope of the appended claims.

What is claimed is:

1. An apparatus to dry a material by centrifugal force, comprising:

a frame;

a shaft mounted, for rotational motion about a first axis on said frame, said rotational motion sufficient to produce a centrifugal force;

a conveyor assembly mounted to said shaft for rotation therewith, said conveyor assembly having a conveyor extending in a direction parallel the first axis from a first position to a second position and a drive mechanism for moving the conveyor to convey material on the conveyor from the first position to the second position; and a drive ring mounted for rotation about the first axis and in engagement with the drive mechanism of the conveyor assembly, rotation of the drive ring with the conveyor assembly inducing no motion of the conveyor in the direction parallel the first axis, relative rotation between the drive ring and conveyor assembly inducing motion of the conveyor in the direction parallel the first axis through the drive mechanism.

2. The apparatus of claim 1 wherein a plurality of conveyor assemblies are mounted on said shaft.

3. The apparatus of claim 1 further comprising a drive means for rotating the shaft and attached conveyor assembly at a first rotational velocity for loading and unloading of the conveyor and a second rotational velocity for drying the material on the conveyor.

4. The apparatus of claim 1 further comprising a loading conveyor extending proximate a first end of the conveyor, material on said loading conveyor falling by gravity onto the conveyor of the apparatus while the conveyor is moving from the first to the second position to load the conveyor with material to be dried.

5. The apparatus of claim 4 further comprising means for removing dried material from the conveyor simultaneously while the conveyor is being loaded with material to be dried from the supply conveyor.

* * * * *